US006126210A

United States Patent [19]

Tom

[11] Patent Number: 6,126,210

[45] Date of Patent: Oct. 3, 2000

[54] METHOD AND APPARATUS FOR RELEASING A LATCH WITH TWO SIMULTANEOUS NON-PARALLEL MOTIONS

[76] Inventor: Anita Lee Tom, 684 Funston Ave., San Francisco, Calif. 94118

[21] Appl. No.: 09/267,718

[22] Filed: Mar. 11, 1999

[51] Int. Cl.[7] ..... E05C 19/10

[52] U.S. Cl. ..... 292/119; 292/158; 292/DIG. 63; 292/DIG. 65

[58] Field of Search ..... 292/97, DIG. 24, 292/254, 120, 119, DIG. 65, DIG. 63, 158, 168; 70/289, 290

[56] References Cited

U.S. PATENT DOCUMENTS

| | | | |
|---|---|---|---|
| 380,738 | 4/1888 | Bachman | 292/DIG. 63 |
| 690,191 | 12/1901 | Saxe | 70/352 |
| 2,936,189 | 5/1960 | Pearson | 292/DIG. 65 |
| 2,997,872 | 8/1961 | Fry | 70/298 |
| 3,160,431 | 12/1964 | Anderson et al. | 292/DIG. 65 |
| 3,514,981 | 6/1970 | Esquibel et al. | 70/298 |
| 3,590,614 | 7/1971 | Kunst | 70/298 |
| 3,821,885 | 7/1974 | Gerry | 70/298 |
| 3,893,721 | 7/1975 | Upton | 292/30 |
| 4,045,063 | 8/1977 | Fletcher et al. | 292/110 |
| 4,286,809 | 9/1981 | Godwin | 292/54 |
| 5,172,575 | 12/1992 | Fisher | 70/63 |
| 5,189,894 | 3/1993 | Buck | 70/63 |
| 5,465,191 | 11/1995 | Nomura et al. | 361/681 |
| 5,560,232 | 10/1996 | Chen | 70/30 |
| 5,632,165 | 5/1997 | Perry | 70/30 |

*Primary Examiner*—B. Dayoan
*Assistant Examiner*—Clifford B Vaterlaus
*Attorney, Agent, or Firm*—Risto A. Rinne, Jr.

[57] ABSTRACT

A method and apparatus for providing a latch is disclosed that impedes opening the latch by those, regardless of age, who lack the necessary mental acuity. The latch includes a release mechanism that requires two vertical slide members to be displaced in a first direction and held in that displaced position before a horizontal slide member can be displaced in a second direction that is not parallel with the first direction. The horizontal slide member is connected by a cord with a latch portion of the mechanism. When the horizontal slide member is displaced in the second direction, the latch portion is released from engagement and the latch is itself opened.

14 Claims, 1 Drawing Sheet

METHOD AND APPARATUS FOR RELEASING A LATCH WITH TWO SIMULTANEOUS NON-PARALLEL MOTIONS

The subject matter of this application is related to a prior application by the same inventor filed on Jul. 7, 1997, application Ser. No. 08/893,358 and currently approved for issuance as United States Letters Patent.

BACKGROUND OF THE INVENTION

1. Field of the Invention

The present invention, in general relates to mechanical latches such as are found on cabinets and doors and, more particularly, to latches that increase safety by hampering use by those who lack a certain level of mental acuity.

There are numerous instances when it is desirable to impede access to certain areas. For example, it is desirable to prevent infants from accessing closets that contain toxic substances, such as potent cleansers and the like.

It is also desirable to be able to prevent toddlers and young children from opening certain doors that provide access into potentially dangerous areas. For example, it is desirable to prevent toddlers at a preschool from gaining access into a utility room that has dangerous power tools nearby or from opening a back door that leads off premises and onto a street.

The same applies to developmentally delayed individuals or the very aged who may be afflicted with any disease process that affects mental acuity such as Alzheimer's patients, for example.

While desirable to impede access to certain individuals, it is conversely desirable to permit ready access to these areas by people whom are deemed competent to do so.

This is not an issue of high security that the present invention addresses. Rather, what is needed is a method and an apparatus that permits entry into an area, where desired, by reasonably competent people who by their physical ability have a presumption of authority to do so and which impedes access to those who, by reason of their young age or lack of mental acuity, do not share that same physical ability and therefore, are presumed to not partake of the same presumption of authority.

Childproof safety latches are known that impede access by infants and smaller children into certain areas, such as kitchen cabinets that contain poisonous substances. A problem with such safety latches is that, while effective at preventing access by children, they also significantly impede access by adults. Furthermore, even adults with substantial mental infirmities are still able to perform the acts necessary to open certain of these safety latches.

Accordingly, there exists today a need for a method and apparatus for releasing a latch with two simultaneous non-parallel motions that permits operation by those possessed of a minimum baseline level of physical ability that correlates with their mental acuity.

Clearly, such a method and an apparatus would be useful and desirable.

2. Description of Prior Art

Safety latches are, in general, known. While the structural arrangements of the known devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a method and apparatus for releasing a latch with two simultaneous non-parallel motions that impede opening by infants and toddlers.

It is also an important object of the invention to provide a method and apparatus for releasing a latch with two simultaneous non-parallel motions that impede opening by those lacking mentally acuity.

Another object of the invention is to provide a method and apparatus for releasing a latch with two simultaneous non-parallel motions that permits ready opening by those with sufficient mental acuity.

Still another object of the invention is to provide a method and apparatus for releasing a latch with two simultaneous non-parallel motions that impedes opening by those people, regardless of age, whom are experiencing a sufficient degree of mental infirmity so as to raise question as to their ability to exercise prudent judgment if they had access.

Still yet another object of the invention is to provide a method and apparatus for releasing a latch with two simultaneous non-parallel motions that recognizes and utilizes an inherent correlation between physical ability and mental ability whereby a decreasing level of mental ability produces a resultant change in physical ability and by utilizing that change in physical ability to provide a threshold level below which opening of the latch is impeded.

Yet another important object of the invention is to provide a method and apparatus for releasing a latch with two simultaneous non-parallel motions that is useful on cabinets or doors.

Still yet another important object of the invention is to provide a method and apparatus for releasing a latch with two simultaneous non-parallel motions that is useful on drawers.

Briefly, a method and apparatus for releasing a latch with two simultaneous non-parallel motions that is constructed in accordance with the principles of the present invention has a latching mechanism that is attached to a cabinet, door, drawer, or the like and which impedes access to an area. Release of the latching mechanism requires a two-step procedure beginning with the simultaneous application of a sufficient vertical force applied to urge a pair of vertical slide members in a first or vertical direction. The vertical force must be maintained in order for a second step to be accomplished. After the pair of vertical slide members have been displaced, the application of a sufficient horizontal (sideways) force is applied to urge a horizontal slide member in a second direction or horizontally, thereby releasing the latching mechanism. Each of the three required forces are applied by a separate digit, preferably of the same hand.

DETAILED DESCRIPTION OF THE INVENTION

Figure 1:
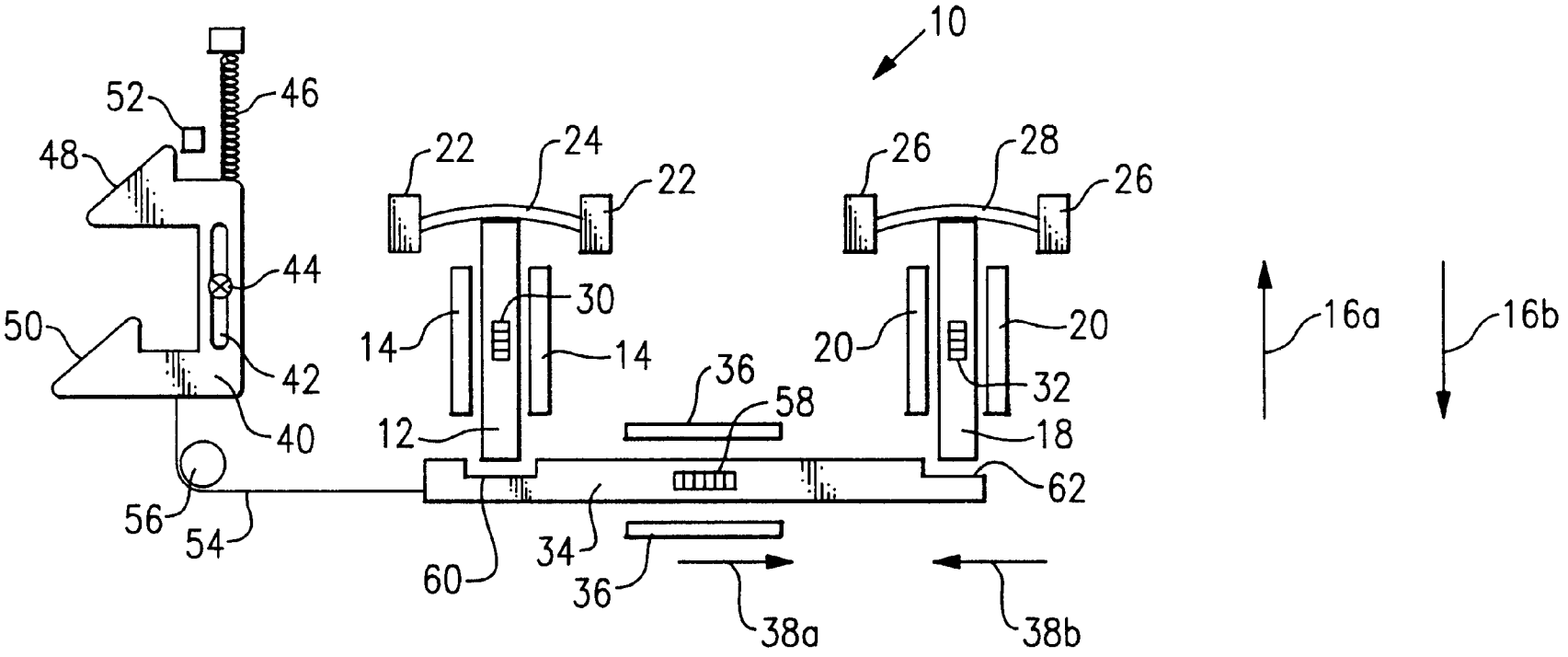
FIG. 1 is a front elevational view of a latch mechanism with two simultaneous non-parallel motions necessary to effect the release thereof.

Referring to FIG. 1 is shown a latch mechanism that is identified in general by the reference numeral 10.

A first vertical slide member 12 is disposed between a first pair of vertical slide rails 14. The first vertical slide member 12 is capable of a limited range of up and down motion, the direction of which is indicated by a first pair of arrows 16*a*, 16*b* and which is described in greater detail hereinafter.

A second vertical slide member 18 is disposed between a second pair of vertical slide rails 20. The second vertical slide member 18 is also capable of a limited range of up and down motion, the direction of which is indicated by the first pair of arrows 16*a*, 16*b* and which is described in greater detail hereinafter.

A first pair of anchor blocks 22 secure a first spring 24 that is disposed intermediate each of the first pair of anchor blocks 22. The first spring 24 supplies a force upon the first vertical slide member 12 that normally urges it in a first direction corresponding with that of arrow 16*b*.

The first spring 24, as is true with all other springs as are described in greater detail hereinafter, are formed of whatever material is preferred. They may be metallic or formed of an elastomer, such as a rubber band.

A second pair of anchor blocks 26 secure a second spring 28 that is disposed intermediate each of the second pair of anchor blocks 26. The second spring 28 supplies a force upon the second vertical slide member 18 that normally urges it in a first direction corresponding also with that of arrow 16*b*.

The first vertical slide member 12 includes a first knurled surface 30. The second vertical slide member 18 includes a second knurled surface 32. The first and second knurled surfaces 30, 32 provide a protrusion that a user (not shown) can bear against and move with a digit of his hand, as is described in greater detail hereinafter.

A horizontal slide member 34 is disposed intermediate a pair of horizontal slide rails 36. The horizontal slide member 34 is capable of a limited range of side to side motion, the direction of which is indicated by a second pair of arrows 38*a*, 38*b* and which is described in greater detail hereinafter.

A catch 40 includes a slot 42 and includes a screw 44 that passes through the slot 42 and secures the catch 40 in position. The catch 40 is capable of a limited range of up and down motion (as shown) that corresponds with the first pair of arrows 16*a*, 16*b*.

A third spring supplies a force that tends to urge the catch 40 in an upward direction indicated generally by arrow 16*a*.

The catch 40 includes a first latch portion 48 and an optional second latch portion 50, the second latch portion 50 providing increased strength and security where needed but not utilized in the FIG. 1 drawing.

The first latch portion 48 secures a member 52 in position. The member 52, by way of example, could be attached to a door or drawer (not shown) that is prevented from being opened as shown. If the member 52 were not constrained in position by the first latch portion 48 it would be free to move generally to the left in the direction shown by arrow 38*b*.

A cord 54 is disposed intermediate the catch 40 and the horizontal slide member 34. If the horizontal slide member 34 were to move to the right, in the direction indicated by arrow 38*a*, the cord 54 would transfer this motion to the catch 40 and if the force applied was of sufficient magnitude, the catch would be displaced downward (arrow 16*b*) until the member 52 was free of the first latch portion 48 and able to open. The manner by which this is accomplished is described in greater detail hereinafter.

A pivot 56 is provided only when desired to change the direction of motion of the catch 40 from horizontal to vertical, as shown. The pivot 56 can be a simple post or it can be a pulley to decrease friction and resistance.

The third spring 46 normally keeps the catch 40 in the closed (or locked) position. It also normally exerts a force on the catch 40 that is transferred through the cord 54 to the horizontal slide member 34. As such, the third spring 46 normally keeps the horizontal slide member 34 displaced maximally to the left, in a direction as shown by arrow 38*b*.

A third knurled surface 58 is attached to the horizontal slide member 34.

The horizontal slide member 34 includes a first recess 60 into which an end of the first vertical slide member 12 normally resides. This is so because normally the first spring 24 is exerting a force that continually is urging the first vertical slide member 12 in a downward direction (arrow 16*b*) as far as possible. The third spring 46 normally exerts a force, as described hereinabove, that urges the horizontal slide member 34 to the left (arrow 38*b*) sufficiently far so as to cause the first recess 60 to align with the end of the first vertical slide member 12, at which time the first vertical slide member 12 is urged into the first recess by the first spring 24.

The horizontal slide member 34 includes a second recess 62 into which an end of the second vertical slide member 18 normally resides in a manner and for reasons similar to that as described above regarding the first recess 60 except that the second vertical slide member 18 is urged by forces supplied by the second spring 28.

When either the first vertical slide member 12 or the second vertical slide member 18 are disposed respectively in either the first or second recesses, 60, 62, the horizontal slide member 34 is prevented from being displaced to the right, or in a direction as shown by arrow 38a. This, in turn, prevents movement of the catch 40 from occurring which, therefore, prevents movement of the first latch portion 48 and it also prevents release of the member 52 from occurring as well.

Normally, the entire latching mechanism 10 will be disposed behind a cover (not shown) of some sort to protect it and most importantly, to prevent access to the component parts of the latch mechanism 10 as are described in this specification. The cover is omitted from the FIG. 1 drawing to better reveal components therein.

The cover would typically contain a first, a second, and a third slot through which the first, second, and third knurled surfaces 30, 32, 58 respectively, would protrude.

Operation

Ideally, the latch mechanism 10 is intended for ready release by an applied force coming from three digits of the same hand of the user. To explain release of the latch mechanism 10, assume that the user is using his or her left hand.

The tip of the middle finger is put in contact with the first knurled surface 30. The tip of the index finger is put in contact with the second knurled surface 32. The tip of the thumb is put in contact with the third knurled surface 58.

An upward force in the direction indicated by arrow 16a is applied by the middle finger to the first knurled surface 30 sufficient in magnitude to slide the first vertical member 12 upward until it is free of the first recess 60.

An upward force is simultaneously applied by the index finger to the second knurled surface 32 in the direction indicated also by arrow 16*a* sufficient in magnitude to slide the second vertical member 18 upward until it is free of the second recess 62.

A force to the right as indicated by arrow 38*a* that is perpendicular with respect to arrow 16*a* is applied by the thumb to the third knurled surface 58 that is sufficient in magnitude to overcome the force of the third spring 46 and is therefore able slide the horizontal slide member 34 to the right. The motion of the horizontal slide member 34, acting through the cord 54, pulls upon and releases the catch 40 thereby freeing the member 52 from a position of captive cooperation with the first latch portion 48 of the latching mechanism 10.

It is necessary to first move the two vertical slide members 12, 18 upward and to then move the horizontal slide member in a second non-parallel direction with respect to that of the vertical slide members 12, 18 in order to release the latch mechanism 10.

It has been determined that an ability to express this range of physical motion correlates well with a baseline level of mental ability. In other words, being able to physically release the latch mechanism 10 is indicative that the person is possessed of a reasonable amount of good judgment. Accordingly, a method for correlating physical motion with judgment is realized that provides a quick-release type of a latch for persons who possess the necessary baseline level of mental acuity and which frustrates those who do not have the necessary mental acuity.

This correlation is demonstrated to exist regardless of age or infirmity. If a person cannot open the latch mechanism 10 and the latch mechanism 10 is used to secure an area that may contain a hazard, then he or she probably shouldn't have access to the area.

This is useful not only for infants, toddlers, and small children, but also for those who are psychologically developmentally delayed or impaired. For example, a normally healthy person who by reason of intoxication is unable to exercise prudent judgment would also likely find himself or herself unable to readily open the latch mechanism 10. If the latch mechanism 10 were, for example, associated with the operation of heavy equipment or a motor vehicle, its use would be denied to an intoxicated person. The same would apply to a person who as a result of the consumption or use of a drug similarly became impaired.

In the preceding description, the member 52 was described as being either constrained by the latch mechanism 10 or freed therefrom. This relationship is relative and in actual use, if preferred, the member 52 may be fixed in place and the latch mechanism 10 may be attached to an object that, once released, moves relative to the member 52.

The latch mechanism 10 may be housed in any appropriate container (not shown) or under the cover to protect it. It can be disposed at any attitude such as horizontally or vertically or angled as desired depending upon the application at hand. Its use is not limited to the items discussed in this specification. Rather, they are intended only to provide examples where the latch mechanism 10 may be used.

A preferred direction of orientation places the latch mechanism so that the vertical slide members 12, 18 are moved in a downward direction by the digits of the user. This has been found to be generally easier than certain other positions, however it is not intended to limit placement of the latch mechanism 10.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A latch with two simultaneous non-parallel motions, said latch adapted for use by a user, comprising:

(a) a vertical slide member adapted for motion in a first direction and in an opposite direction with respect to said first direction, said vertical slide member disposed on an exterior surface;

(b) a horizontal slide member disposed on said exterior surface; said horizontal slide member including a recess adapted to receive an end of said vertical slide member and adapted for motion in a second direction to secure said latch in a closed position when said end of said vertical slide member is disposed in said recess and adapted for motion in an opposite direction with respect to said second direction when said end of said vertical slide member is not disposed in said recess;

(c) means for supplying a force to urge said vertical slide means in said first direction into said recess; and (d) means for latching attached to said horizontal slide member whereby said means for latching is secured in a closed position when said horizontal slide member is disposed in said second position and is in an open position when said horizontal slide member is displaced in said opposite direction with respect to said second direction;

wherein said horizontal slide member is prevented from moving toward said opposite direction with respect to said second direction until said vertical slide member has first been displaced in said opposite direction with respect to said first direction by applying a force to said vertical slide member in said opposite direction with respect to said first direction by a first digit of said user sufficient to remove said end of said vertical slide member from said recess and by applying a second force to said horizontal slide member in said opposite direction with respect to said second direction by a second digit of said user.

2. The latch of claim 1 including a second vertical slide member, wherein said second vertical slide member includes an end that cooperates with a second recess in said horizontal slide member.

3. The latch of claim 2 wherein said horizontal slide member is prevented from moving toward said opposite direction with respect to said second direction until said vertical slide member has first been displaced in said opposite direction with respect to said first direction sufficient to remove said end of said vertical slide member from said recess and said second vertical slide member has also been displaced in a direction sufficient to move said end of said second vertical slide member away from a position of cooperation with said second recess.

4. The latch of claim 3 including a first knurled surface attached to said first vertical slide member, a second knurled surface attached to said second vertical slide member, and a third knurled surface attached to said horizontal slide member wherein each of said first, second, and third knurled surfaces are adapted to facilitate the displacement of said first vertical slide member, said second vertical slide member, and said horizontal slide member, respectively by a force applied thereto by the digits of a user.

5. The latch of claim 1 wherein said means for supplying a force to urge said vertical slide means in said first direction includes a spring.

6. The latch of claim 1 wherein said means for supplying a force to urge said vertical slide means in said first direction includes an elastomer.

7. The latch of claim 6 wherein said elastomer is made of rubber.

8. The latch of claim 6 wherein said elastomer is a rubber band.

9. The latch of claim 1 wherein said means for latching includes means for urging said means for latching into said closed position.

10. The latch of claim 9 wherein said means for urging includes a spring.

11. The latch of claim 9 wherein said means for urging includes an elastomer.

12. The latch of claim 1 wherein said means for latching is attached to said horizontal slide member by a cord.

13. The latch of claim 1 wherein said means for latching includes a first latch portion attached thereto.

14. The latch of claim 13 wherein said means for latching includes a second latch portion attached thereto.

* * * * *